US009130314B2

(12) United States Patent
Pao et al.

(10) Patent No.: US 9,130,314 B2
(45) Date of Patent: Sep. 8, 2015

(54) COMMUNICATION CONNECTOR AND TERMINAL LEAD FRAME THEREOF

(71) Applicant: Topconn Electronic (Kunshan) Co., Ltd, Suzhou, Jiangsu Province (CN)

(72) Inventors: Chung-Nan Pao, New Taipei (TW); Xiao-Yin Wang, Suzhou (CN); Yu-Hsiung Lin, New Taipei (TW)

(73) Assignee: TOPCONN ELECTRONIC (KUNSHAN) CO., LTD., Suzhou, Jiangsu Province (CN)

( * ) Notice: Subject to any disclaimer, the term of this patent is extended or adjusted under 35 U.S.C. 154(b) by 22 days.

(21) Appl. No.: 14/104,088

(22) Filed: Dec. 12, 2013

(65) Prior Publication Data

US 2015/0079821 A1 Mar. 19, 2015

(30) Foreign Application Priority Data

Sep. 17, 2013 (CN) ..... 2013 1 0426407

(51) Int. Cl.
*H01R 13/514* (2006.01)
*H01R 13/6587* (2011.01)

(52) U.S. Cl.
CPC ..... *H01R 13/6587* (2013.01)

(58) Field of Classification Search
CPC ..... H01R 12/724; H01R 13/514
See application file for complete search history.

(56) References Cited

U.S. PATENT DOCUMENTS 7,566,247 B2 * 7/2009 Rothermel et al. ..... 439/607.05
7,585,186 B2 * 9/2009 McAlonis et al. ..... 439/607.05
7,722,401 B2 * 5/2010 Kirk et al. ..... 439/607.07
7,727,017 B2 * 6/2010 Amleshi et al. ..... 439/607.11
7,794,278 B2 * 9/2010 Cohen et al. ..... 439/607.09
7,862,347 B2 * 1/2011 Amleshi et al. ..... 439/82
7,867,031 B2 * 1/2011 Amleshi et al. ..... 439/607.08
7,878,853 B2 * 2/2011 Amleshi et al. ..... 439/607.08
7,914,303 B2 * 3/2011 Amleshi et al. ..... 439/82
7,963,776 B1 * 6/2011 Morgan ..... 439/75
7,963,806 B1 * 6/2011 Scott Kline et al. ..... 439/660
7,980,896 B1 * 7/2011 Morgan ..... 439/607.05
8,231,415 B2 * 7/2012 Johnescu et al. ..... 439/701
8,342,888 B2 * 1/2013 Amleshi et al. ..... 439/676
8,361,896 B2 * 1/2013 De Geest ..... 438/607
8,366,485 B2 * 2/2013 Johnescu et al. ..... 439/607.07
8,382,521 B2 * 2/2013 Minich et al. ..... 439/607.05
8,382,524 B2 * 2/2013 Khilchenko et al. ..... 439/620.09
8,469,720 B2 * 6/2013 Gulla ..... 439/65
8,628,356 B2 * 1/2014 Laurx et al. ..... 439/628
8,715,003 B2 * 5/2014 Buck et al. ..... 439/607.07
8,734,187 B2 * 5/2014 De Geest et al. ..... 439/626
8,771,016 B2 * 7/2014 Atkinson et al. ..... 439/607.07
8,894,442 B2 * 11/2014 McClellan et al. ..... 439/607.05
8,900,014 B2 * 12/2014 Kondo ..... 439/660
8,961,229 B2 * 2/2015 Pan ..... 439/607.07

(Continued)

*Primary Examiner* — Ross Gushi

(74) *Attorney, Agent, or Firm* — Li & Cai Intellectual Property (USA) Office

(57) ABSTRACT

A terminal lead frame comprises a frame and a plurality of terminal pairs set in the frame. The frame is a first dielectric material. The terminal pairs include a first terminal and a second terminal. The first terminal and the second terminal include a first and second extensions extending into the frame along with a first path and a second path, respectively. The first path is longer than the second path, wherein the first extension contacts with a second material to form a first area of contact while the second extension has a second area of contact with respect to the second dielectric material. The first area of contact is larger than the second area of contact.

20 Claims, 13 Drawing Sheets

(56) References Cited

U.S. PATENT DOCUMENTS

| | | | | |
|---|---|---|---|---|
| 2002/0123266 | A1* | 9/2002 | Ramey et al. | 439/608 |
| 2006/0245137 | A1* | 11/2006 | David et al. | 361/118 |
| 2008/0246555 | A1* | 10/2008 | Kirk et al. | 333/125 |
| 2008/0316729 | A1* | 12/2008 | Rothermel et al. | 361/813 |
| 2009/0011643 | A1* | 1/2009 | Amleshi et al. | 439/608 |
| 2009/0017681 | A1* | 1/2009 | Amleshi et al. | 439/608 |
| 2009/0291593 | A1* | 11/2009 | Atkinson et al. | 439/607.06 |
| 2010/0093209 | A1* | 4/2010 | Liu et al. | 439/541.5 |
| 2010/0240233 | A1* | 9/2010 | Johnescu et al. | 439/108 |
| 2011/0256763 | A1* | 10/2011 | De Geest et al. | 439/607.01 |
| 2012/0058684 | A1* | 3/2012 | De Geest et al. | 439/660 |
| 2012/0178292 | A1* | 7/2012 | Kumamoto et al. | 439/607.01 |
| 2013/0109232 | A1* | 5/2013 | Paniaqua | 439/607.07 |
| 2013/0109246 | A1* | 5/2013 | Minich et al. | 439/682 |
| 2013/0225006 | A1* | 8/2013 | Khilchenko et al. | 439/660 |
| 2014/0065883 | A1* | 3/2014 | Cohen et al. | 439/626 |
| 2014/0099829 | A1* | 4/2014 | Laurx et al. | 439/628 |
| 2014/0187089 | A1* | 7/2014 | Buck et al. | 439/620.01 |
| 2014/0273557 | A1* | 9/2014 | Cartier et al. | 439/78 |
| 2014/0273627 | A1* | 9/2014 | Cartier et al. | 439/607.11 |
| 2014/0273651 | A1* | 9/2014 | Pao et al. | 439/660 |
| 2014/0273663 | A1* | 9/2014 | Cartier et al. | 439/692 |
| 2014/0357133 | A1* | 12/2014 | Drijfhout et al. | 439/701 |
| 2014/0370723 | A1* | 12/2014 | Laurx et al. | 439/76.1 |
| 2015/0024635 | A1* | 1/2015 | McClellan et al. | 439/629 |

* cited by examiner

COMMUNICATION CONNECTOR AND TERMINAL LEAD FRAME THEREOF

BACKGROUND OF THE INVENTION

1. Field of the Invention

The instant disclosure relates to a communication connector and terminal lead frame thereof enhance or improve high frequency signal transmission quality of communication connectors through adjusting dielectric assembly in contact with an electrical terminal.

2. Description of Related Art

Please refer to FIG. 1 as an example of a conventional connector and communication connector. Typically, a differential terminal pair T is used for electrical transmission. The differential terminal pair T has a first tip T1 which extends into a dielectric casing S. The dielectric casing S covers a mid-section of the first tip, first terminal wiring T11, therein. The first terminal wiring T11 then extends out of the dielectric casing S and exposes a first tail T13 therefrom. Similarly, the dielectric casing S covers a mid-section of a second tip T2, second terminal wiring T21, therein. The first terminal wiring T11 and second terminal wiring T21 are enveloped in and physically contact the dielectric casing S. Typically, the dielectric casing S envelopes the differential terminal pair T or the conductive body within the electric connector to provide insulation. Although dielectric casing S provides good insulating, impedance of the conductive body within the casing S is affected as well as transmission efficiency. Especially, electrical connectors transmitting differential signals are substantially affected when using differential terminal pair T. Accordingly, differential terminal pair T usually has two terminals in which one having a length longer than the other, such that two non-symmetrical terminals provide unbalanced transmission. Moreover, influence of casing S on various lengths of terminal pair T varies, which further amplifies differences in transmission between the two terminals. However, this crucial matter of differential signal transmission that has not yet been resolved cannot be ignored due to its substantial influences on non-equal length current terminal connectors or other connectors, and their respective differential signal transmission quality as well as efficiency. Thus, there is room for improvements, among which the most influential factor is high-frequency transmission.

To address the above issues, the inventor strives via associated experience and research to present the instant disclosure, which can effectively improve the limitation described above.

SUMMARY OF THE INVENTION

The object of the instant disclosure is to a terminal lead frame, comprises an insulating frame being a first dielectric, the insulating frame including a tip exposing portion, a tail exposing portion, and two side surfaces; and a plurality of terminal pairs disposed in the insulating frame, at least one of the terminal pairs including a first terminal and a second terminal, the first terminal including a first extension extending along a first path, the second terminal including a second extension extending along a second path, the length of the first path is longer than the length of the second path, the first terminal and the second terminal each have a tip end extending from and arranged at the tip exposing portion, the respective tip ends of the first terminal and the second terminal extends into the insulating frame via the first extension and second extension, first terminal and second terminal each have a tail end extending from and arranged at the tail exposing portion; wherein at least a portion of the first extension exposes from at least one side surface of the insulating frame and is in contact with a second dielectric to define a first contact area, at least a portion of the second extension exposes from at least one side surface of the insulating frame and is in contact with the second dielectric to define a second contact area, the first contact area is larger than the second contact area, and the dielectric constant of the second dielectric is smaller than the dielectric constant of the first dielectric.

In order to achieve the aforementioned objects, according to an embodiment of the instant disclosure, a terminal lead frame, comprises: an insulating frame being a first dielectric, the insulating frame including a tip exposing portion, a tail exposing portion, and two side surfaces; and a plurality of terminal pairs disposed in the insulating frame, at least one of the terminal pairs includes a first terminal and a second terminal, the first terminal includes a first extension extending along a first path, the second terminal includes a second extension extending along a second path, the length of the first path is longer than the length of the second path, the first terminal and the second terminal each have a tip end extending from and arranged at a tip exposing portion, the respective tip ends of the first terminal and the second terminal extend into the insulating frame via the first extension and second extension, the first terminal and the second terminal each have a tail end extending from and arranged at the tail exposing portion; wherein at least a portion of the first extension exposes from at least one side surface of the insulating frame and is in contact with a second dielectric, the second extension is separated from the second dielectric, and the dielectric constant of the second dielectric is smaller than the dielectric constant of the first dielectric.

In order to achieve the aforementioned objects, according to an embodiment of the instant disclosure, a communication connector, comprises: a guiding adaptor; and a plurality of terminal lead frames. At least one of the terminal lead frame comprises: an insulating frame being a first dielectric, the insulating frame includes at least a tip exposing portion, a tail exposing portion, and two side surfaces, a direction normal to the side surfaces defines as a first direction, the insulating frames of the terminal lead frames are arranged side by side one another along the first direction in guiding adaptor; and a plurality of terminal pairs is disposed in the insulating frame, at least one of the terminal pairs includes a first terminal and a second terminal, the first terminal includes a first extension extending along a first path, the second terminal includes a second extension extending along a second path, the length of the first path is longer than the length of the second path, the first terminal and the second terminal each have a tip end extending from and arranged at the tip exposing portion; wherein at least a portion of the first extension exposes from at least one side surface of the insulating frame and is in contact with a second dielectric to define a first contact area, at least a portion of the second extension exposes from at least one side surface of the insulating frame and is in contact with the second dielectric to define a second contact area, the first contact area is larger than the second contact area, and the dielectric constant of the second dielectric is smaller than the dielectric constant of the first dielectric; wherein the plurality of tip exposing portions is fitted in the guiding adaptor to form an engaging interface; wherein the insulating frame further comprises the tail exposing portion, the respective tip ends of the first terminal and the second terminal extend into the insulating frame via the first extension and second extension, the first terminal and the second terminal each have a tail end extending from and arranged at the tail exposing portion;

wherein the plurality of the tail exposing portion is fitted in the guiding adaptor to form a board interface.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

Figure 1:
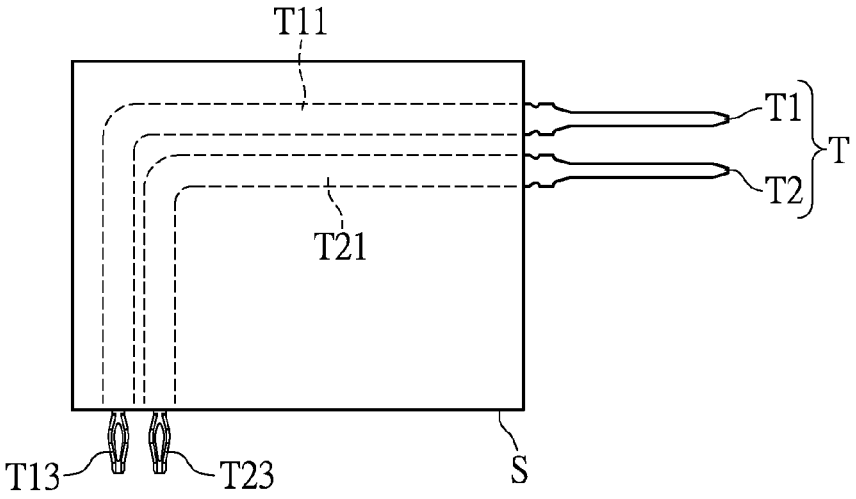
FIG.1 PRIOR ART
FIG. 1 is a schematic diagram of a conventional terminal lead frame.
Figure 2A:
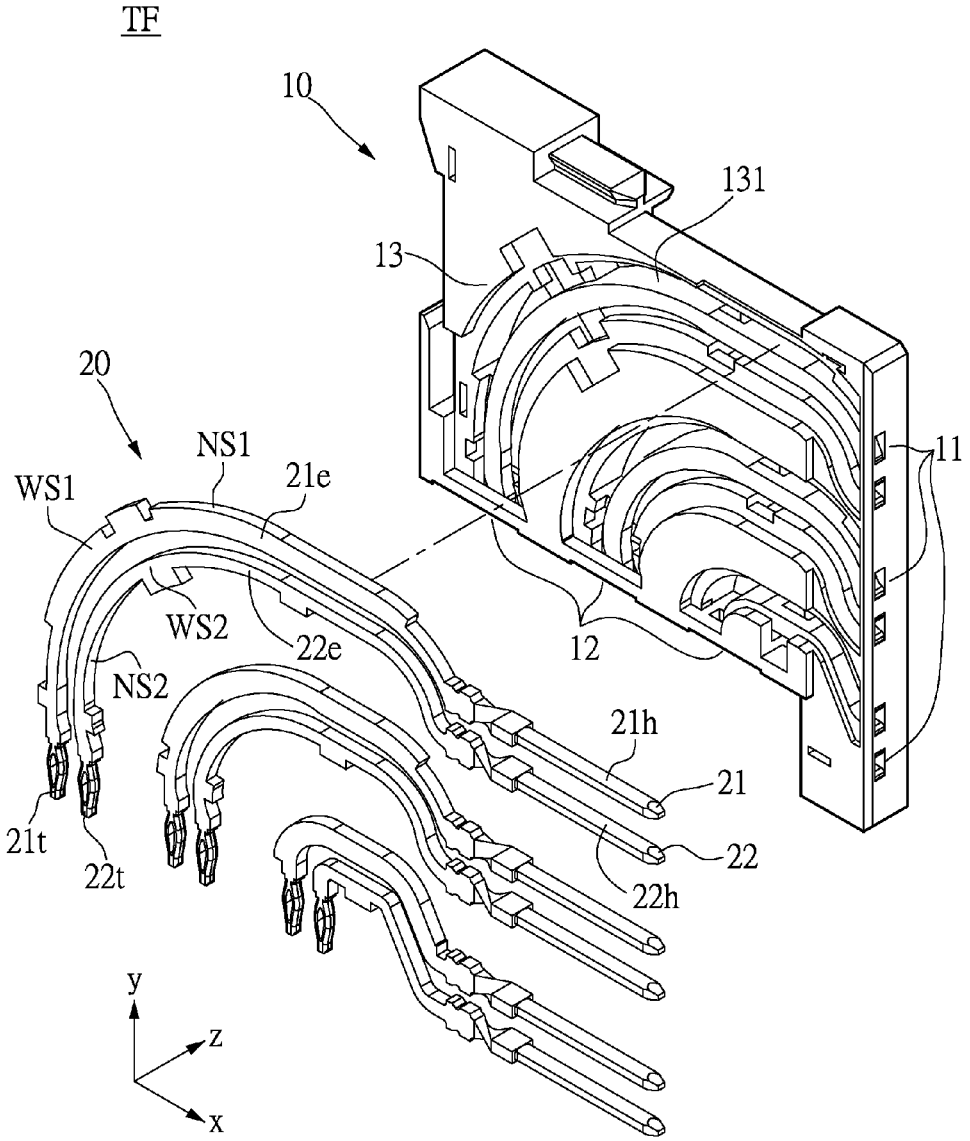
FIG. 2A is an exploded view from above the terminal lead frame in accordance with the instant disclosure.
Figure 2B:
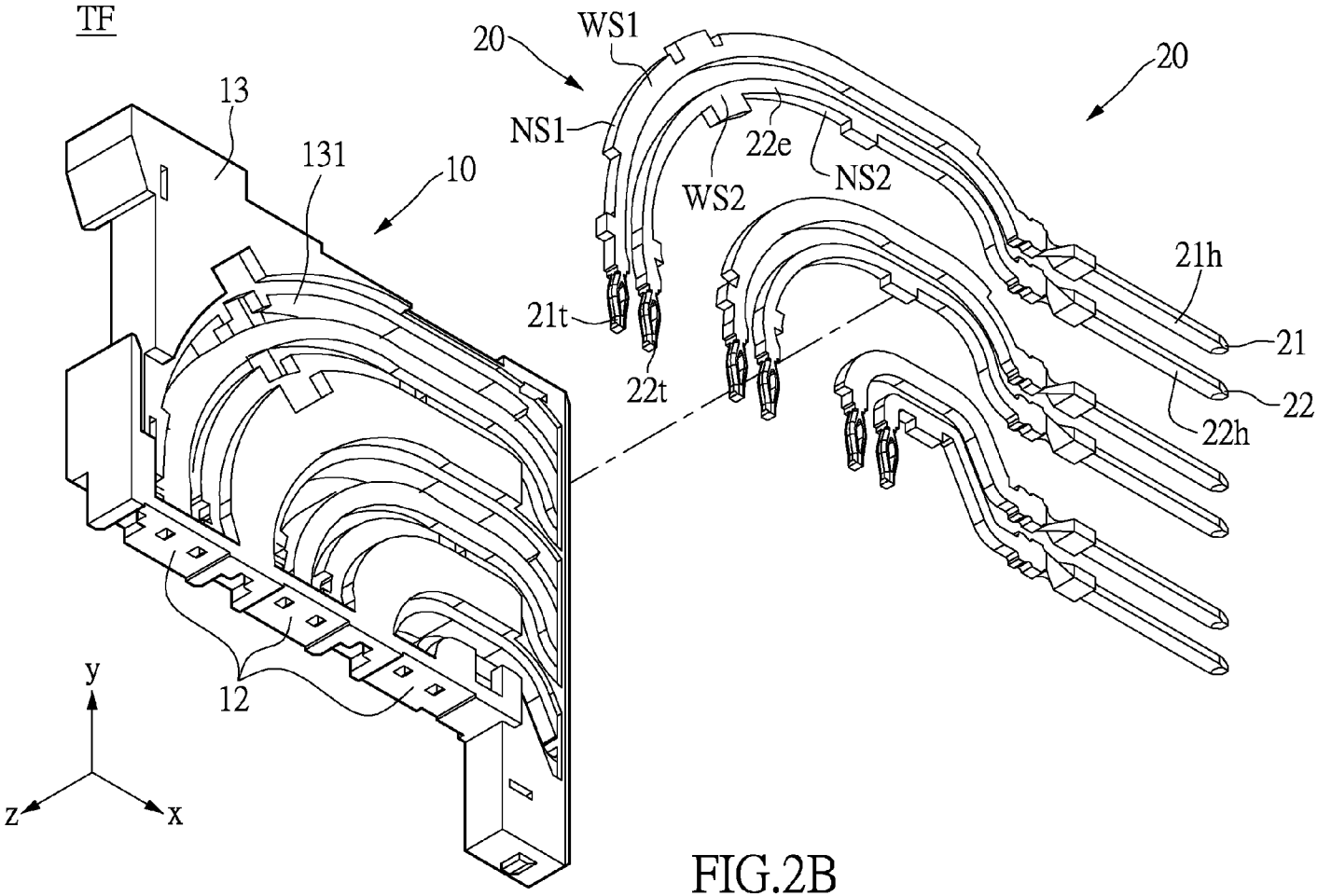
FIG. 2B is an exploded view from below the terminal lead frame in accordance with the instant disclosure.
Figure 2C:
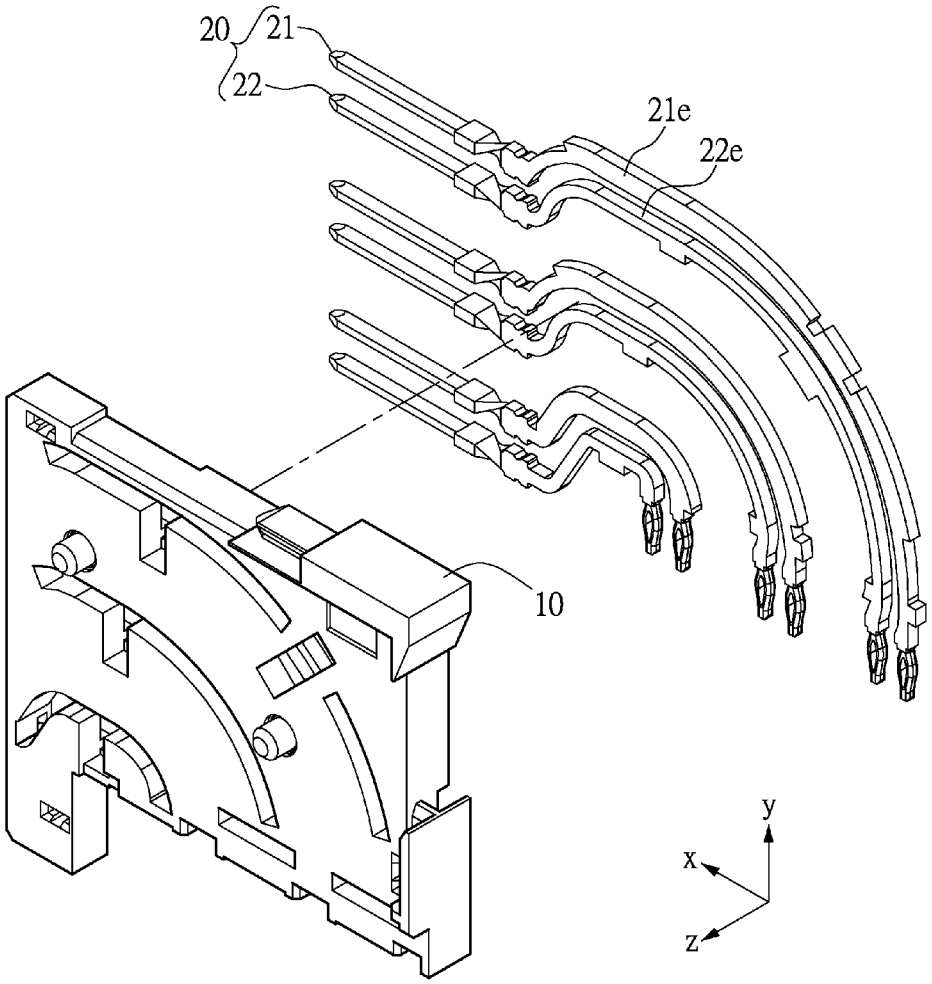
FIG. 2C is another exploded view from above the terminal lead frame in accordance with the instant disclosure.
Figure 2D:
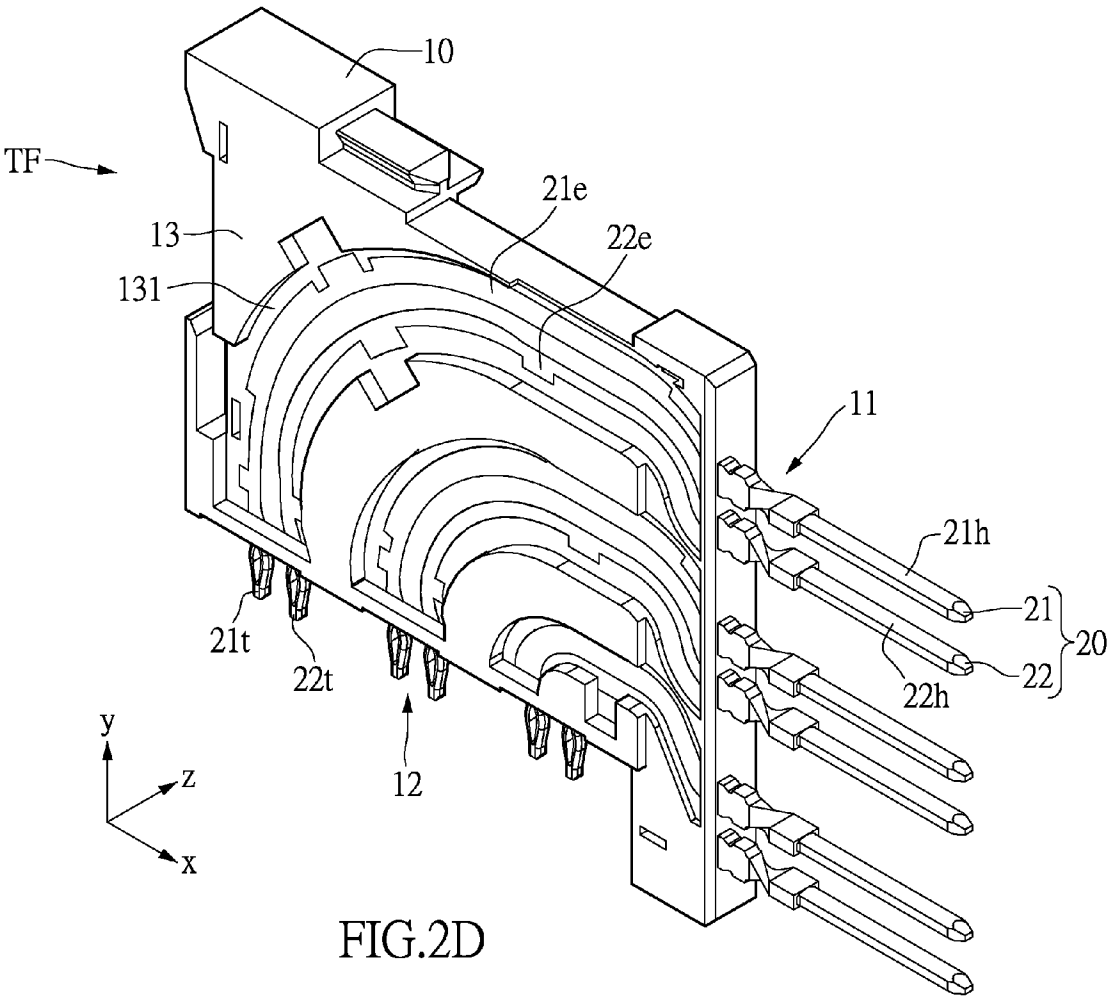
FIG. 2D is an assembled view of the terminal lead frame in accordance with the instant disclosure.

Please refer to FIGS. 2A, 2B, and 2D as the schematic diagrams of a terminal lead frame TF in accordance with the instant embodiment. The terminal lead frame TF includes an insulating frame 10, and a plurality of terminal pairs 20 arranged in the insulating frame 10. Three pairs of terminal pairs 20 are shown in the instant embodiment, however the example provided herein does not limit the scope of the instant disclosure.

The insulating frame 10 can be a plastic material used for insulation or other types of insulating materials and not limited hereto. The insulating frame 10 is a first dielectric (not labeled), which can be in contact with the terminal pairs 20, having a dielectric constant. Take plastic for example; the dielectric constant is approximately 3 to 4. The insulating frame 10 also includes a tip exposing portion 11, a tail exposing portion 12, and two side surfaces 13. The tip exposing portion 11 and the tail exposing portion 12 are defined as two different surfaces on the insulating frame 10 besides the side surfaces 13 and have a plurality of openings arranged thereon, such that tip ends and tail ends of the terminals can extend stretch out for installation with boards, or auxiliary electric engaging components such as electrical connectors. At least one terminal pair 20 includes a first terminal 21 and a second terminal 22. The first terminal 21 includes a first extension 21*e* extending along a first path (not labeled), whereas the second terminal 22 includes a second extension 22*e* extending along a second path (not labeled). The first path and the second path in the instant embodiment refer to the paths between the tip exposing portion 11 and the tail exposing portion 12, and passing through interiors of the insulating frame 10. The length of the first path is longer than that of the second path, such that the first path and the second path are basically the extending paths of the first terminal 21 and the second terminal 22 within the insulating frame 10, respectively. For example, if the electrical connector is a male connector, the two tip ends 21*h*, 22*h* of the first terminal 21 and the second terminal 22 are male ends resembling rod-shaped electrical contacting ends, but not limited hereto. The electrical contacting ends are arranged at the tip exposing portion 11 oriented toward a direction which is defined as a first engaging direction. The tip ends 21*h*, 22*h* can be used to connect to another connector in a female counter part of the male end such as a socket. The first engagement direction is not limited to the male end. The respective tip ends 21*h*, 22*h* of the first terminal 21 and the second terminal 22 extend into the insulating frame 10 via the first extension 21*e* and second extension 22*e*, and the tip ends 21*h*, 22*h* respectively extend and expose tail ends 21*t*, 22*t* from the tail exposing portion 12. The tail ends 21*t*, 22*t* can resemble that of a fish eye for connection to a board terminal of an electric circuit board (not shown in figures).

Preferably, at least a portion of the first extension 21*e* can be exposed from at least one side surface 13 of the insulating frame 10 and be in physical contact with a second dielectric in order to define a first contact area, whereas at least a portion of the second extension 22*e* can be exposed from at least one side surface 13 of the insulating frame 10 and in physical contact with the second dielectric in order to define a second contact area. The first contact area is larger than the second contact area. The second dielectric has a dielectric constant less than that of the first dielectric constant. Preferably, the first extension 21*e* can be exposed via a groove 131 arranged on the insulating frame 10 and be in physical contact with the second dielectric, whereas the second extension 22*e* can be exposed via another groove 131 arranged on the insulating frame 10 and be in physical contact with the second dielectric. The first extension 21*e* and the second extension 22*e* are not only exposed via the grooves 131. Alternatively, in another embodiment, at least one portion of the first extension 21*e* is preferably exposed from at least one side surface 13 of the insulating frame 10 and is in physical contact with the second dielectric, whereas the second extension 22*e* is not in physical contact with the second dielectric. Accordingly, the dielectric constant of the second dielectric is smaller than that of the first dielectric.

The other groove 131 can be filled with a second dielectric (not labeled) therein. The second dielectric is preferably air with a dielectric constant of 1. However, based on preference, other dielectric materials can be filled in the groove 131 to provide contact between the first terminal 21 and the first extension 21*e*. The dielectric in contact with the first extension 21*e* besides air preferably has a dielectric constant smaller than that of the original insulating frame 10. In other words, the path relatively to the second extension is described in terms of the longer first extension, can be in contact with relatively more dielectric with low dielectric constant, such that electrical transmission properties, such as return loss, capacitance, inductance, and impedance which are innately generated with terminals during electrical transmission, can be adjusted for two terminals with various lengths. Moreover, the ratio of the first contact area to the second contact area is preferably larger than the ratio of the length of the first path to the length of the second path. Thus, the first extension 21*e* is completely exposed from a side of the insulating frame 10 according to the previously mentioned embodiment, and the second extension 22*e* is completely exposed from a side of the insulating frame 10 according to another preferred embodiment.

Figure 2E:
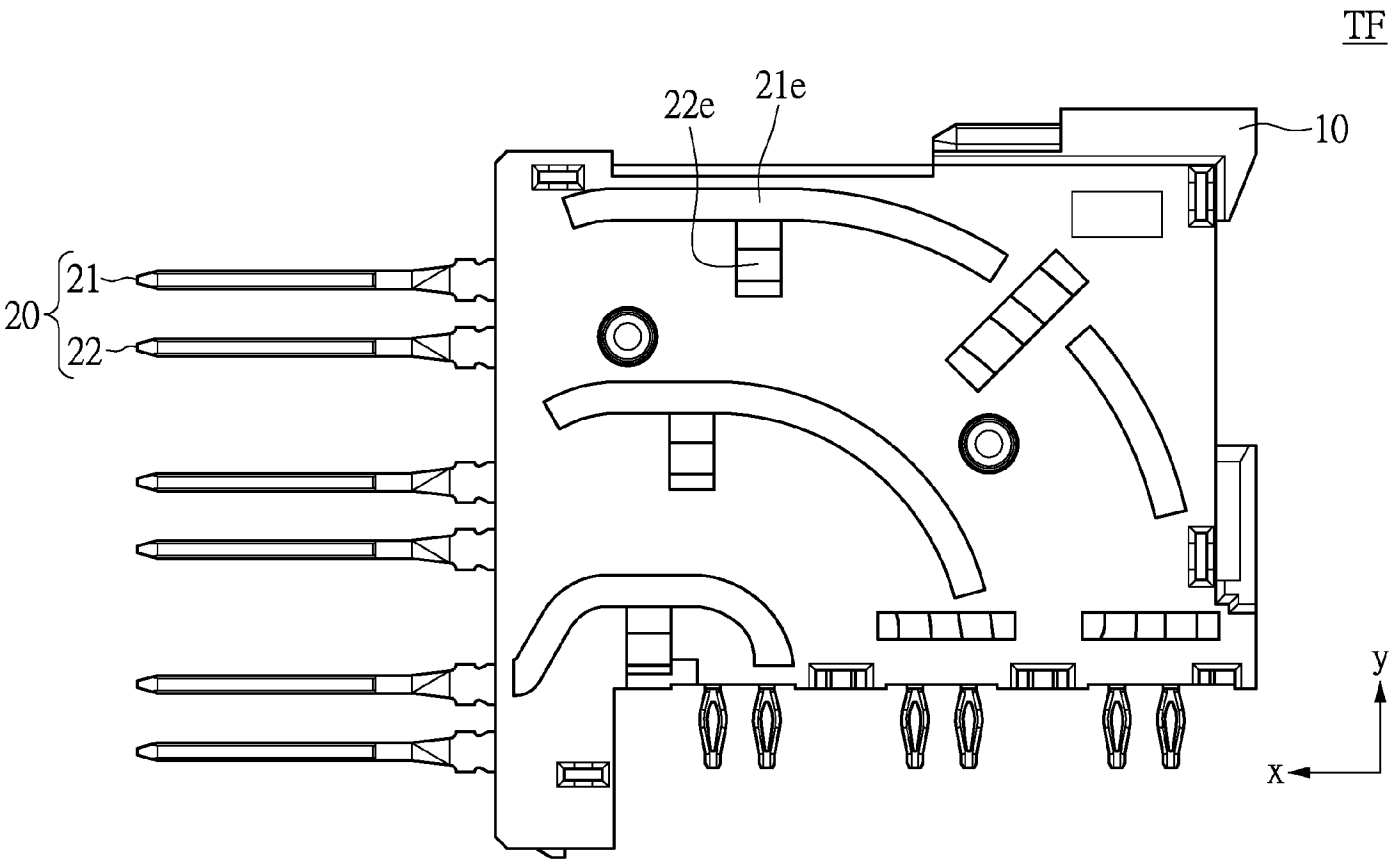
FIG. 2E is a side view of the terminal lead frame in accordance with the instant disclosure.

Please refer again to FIGS. 2B, 2C, 2D and 2E, particularly to FIGS. 2C, and 2E as a different side of the terminal lead frame TF. The first extension 21*e* and second extension 22*e* of the terminal pair 20 can also be exposed on the other side of the insulating frame 10, such that the first terminal 21 and the second terminal 22 can separately contact various dielectrics, in which adjustments can be made to differences in the ratio of dielectric constants and provide more preferable flexibility. However, the terminal pair 20 being exposed to the other side of the insulating frame 10 is optional.

Moreover, the terminal pair 20 is a pair of differential terminal pair in the instant embodiment, the first extension 21*e* and the second extension 22*e* respectively include a broad side (WS1, WS2) and a narrow side (NS1, NS1). The narrow side NS1 of the first extension orients toward the narrow side NS2 of the second extension, such that the first extension 21*e* can electromagnetically coupled (or simplified as coupling) to the narrow side NS2 of the second extension 22*e*. In the instant embodiment, the narrow sides NS1, NS2 can be defined as the coupling side (not labeled), whereas the broad sides WS1, WS2 can be defined as the non-coupling side (not labeled), however the definition of the narrow sides and broad sides are interchangeable and are not limited hereto. In other words, with the terminal pair 20 which can be a differential terminal pair, the first extension 21*e* and the second extension 22*e* can also respectively include a coupling side and a non-coupling side, the coupling side of the first extension 21*e* orients toward the coupling side of the second extension 22*e*, such that the first extension 21*e* and the second extension 22*e* are coupled to each other via their respectively coupling sides. The non-coupling side of the first extension 21*e* and the non-coupling sides of the second extension 22*e* can be in physical contact with the second dielectric having a dielectric constant less than that of the first dielectric. The coupling and non-coupling sides are not respectively limited to only the broad or the narrow sides as aforementioned. In the instant embodiment, the non-coupling side of the first extension 21*e* has a width larger than that of the non-coupling side of the second extension 22*e*, such that that first extension 21*e* can have more available contact surface area compared to that of the second extension 22*e* in contact with the second dielectric having a relatively low dielectric constant. If the groove 131 is not extended along the extension direction or path of the second extension 22*e*, or when the second extension 22*e* is not in contact with the second dielectric which reduces the second contact surface area to zero, the previous effect is also provided. As the first extension 21*e* passes through the tip exposing portion 11, the tip end 21*h* has a twisted portion 401 arranged at a root portion of the tip end 21*h*. Accordingly, the direction of the first extension 21*e* can be changed from originally coupled to the narrow side of the second extension 22*e*, such that the broad side of the terminal pair 20 orients toward the board side and facilitates engagement with external electrical connections thereafter.

Figure 3A:
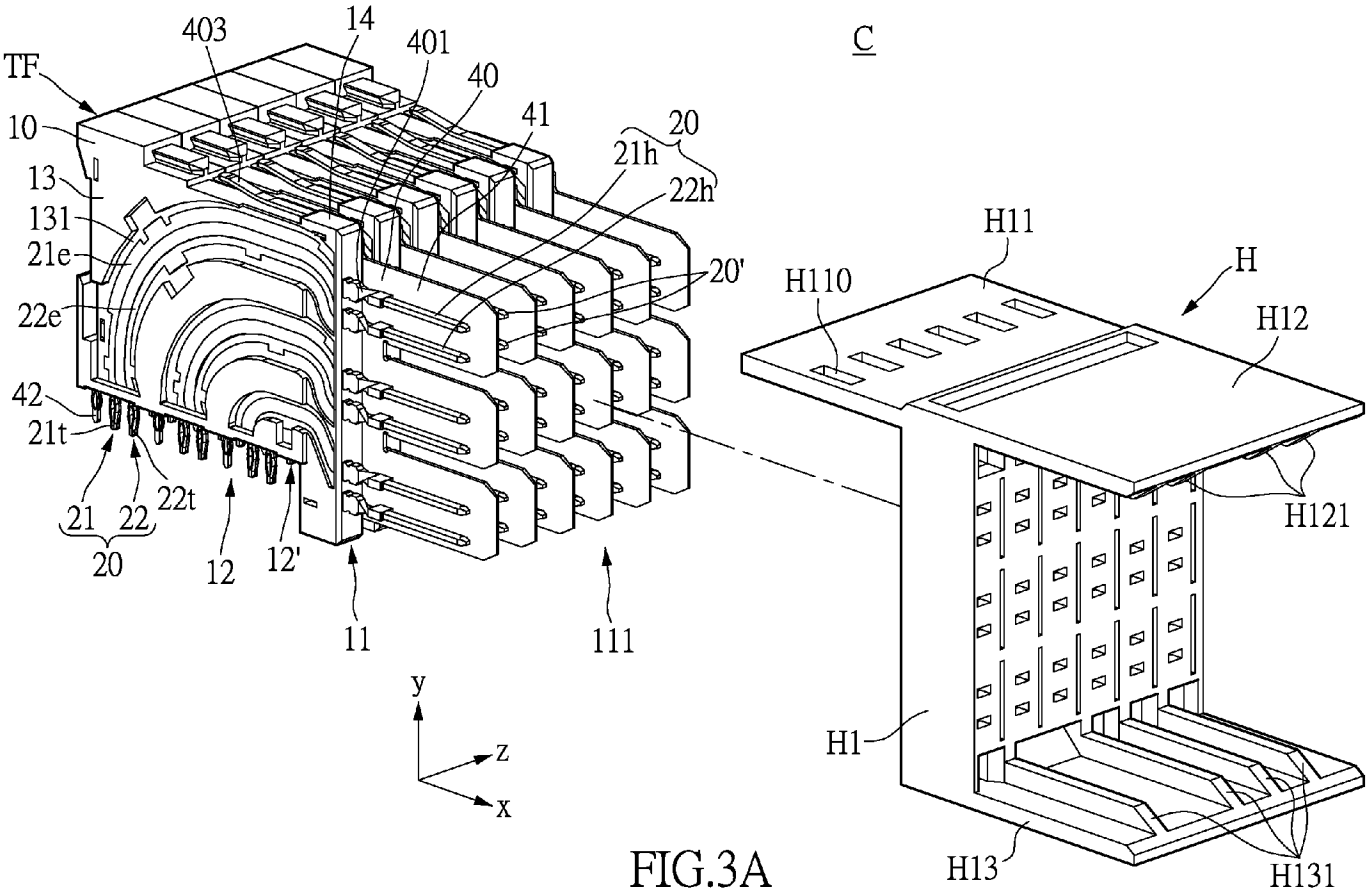
FIG. 3A is an exploded view of a communication electrical connector in accordance with the instant disclosure.
Figure 3B:
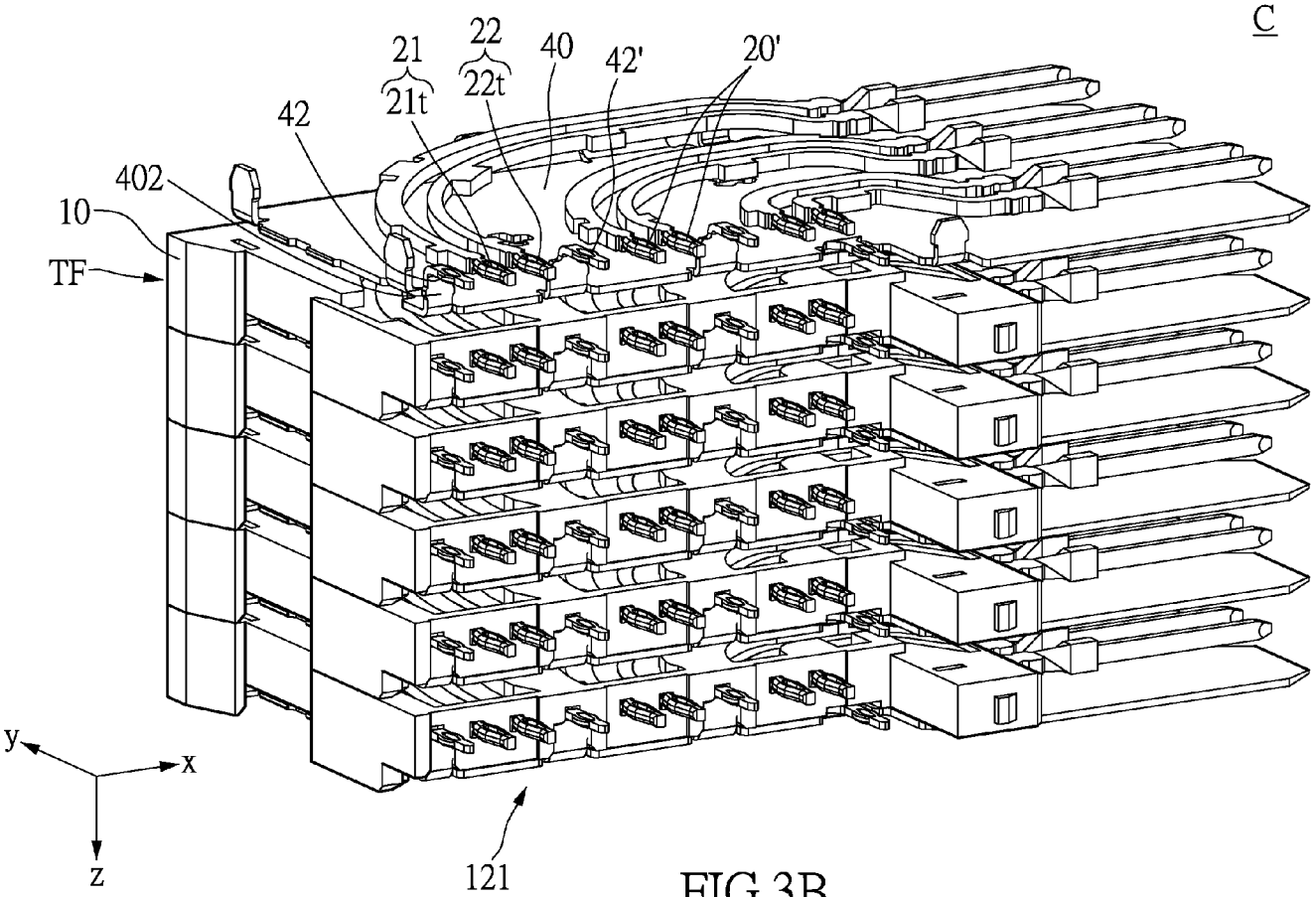
FIG. 3B is an assembled view of the communication electrical connector illustrating plate pins and grounding plates in accordance with the instant disclosure.
Figure 3C:
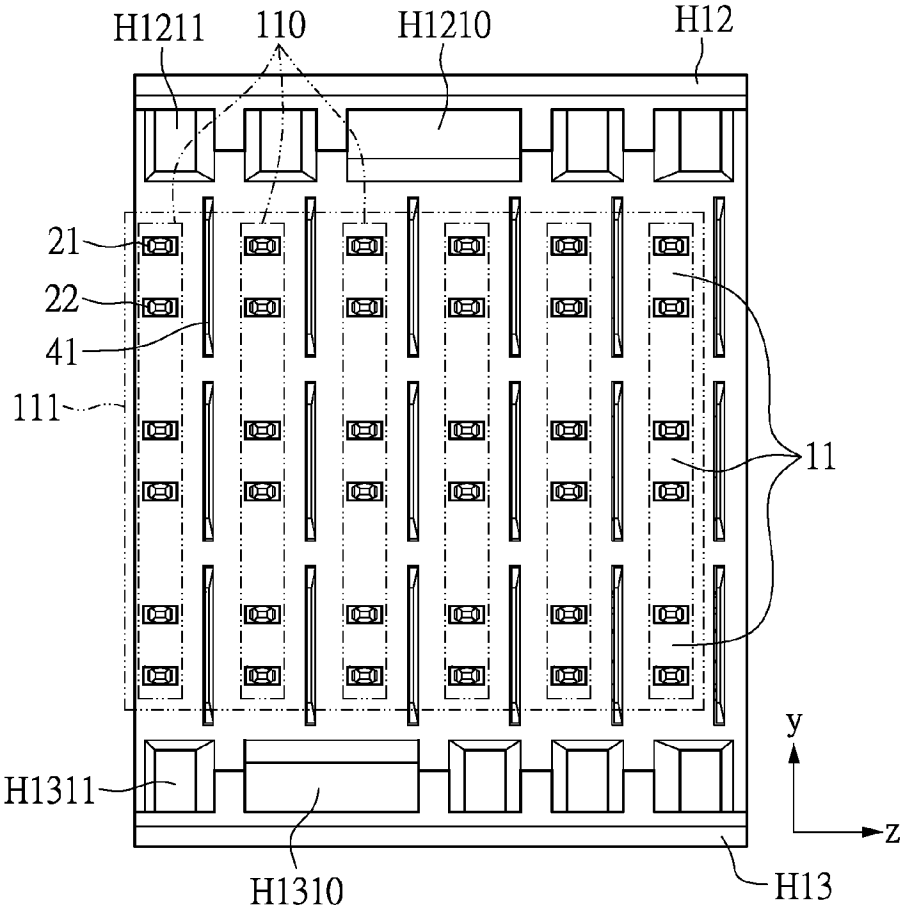
FIG. 3C is a planar view of the communication electrical connector illustrating an engaging end for engaging a second electrical connector in accordance with the instant disclosure.

Please refer to FIGS. 3A, 3B, and 3C. The instant disclosure provides a communication connector C, which includes a guiding adaptor H, and a plurality of terminal lead frame TF as mentioned in previous embodiments. At least one of the frames TF includes an insulating frame 10, and a plurality of terminal pairs 20 configured in the insulating frame 10. The insulating frame is a first dielectric. The insulating frame 10 at least includes a tip exposing portion 11 (along the X axis direction as shown in figures), a tail exposing portion 12 (along the Y axis direction), and a side surface 13. The side surface 13 has at least one groove 131 arranged thereon. A direction normal to the side surface 13 is defined as a first direction, in which the first direction is equivalent to the Z direction in FIG. 3A. The insulating frames 10 (or the terminal lead frame TF) are aligned side-by-side along the first direction (Z axis direction), and connected into the guiding adaptor H. A grounding plate 40 is preferably interposed between each of the side-by-side arranged terminal lead frames TF. As shown in FIG. 3B, the grounding plate 40 orients towards the Z axis direction as the reference direction of the tail exposing portion 12. The grounding plate 40 is bended, a bent portion 402, and extended to form a ground terminal 42 towards the end thereof. The ground terminal 42 is substantially arranged parallel to the tail ends 21*t*, 22*t* of the second terminal 22, and is configured in a tandem repeat arrangement, similar to that of a repeated DNA sequence, with other signal terminals, such as Ground-Signal-Signal (G-S-S), along the X-axis direction in the order of ground terminal 42, tail end 21*t*, ground terminal 42', terminal pair 20' (including two terminals for signals). The signal terminals and the ground terminals in the tail exposing portion 12 can also expand towards the Z-axis direction to form a coplanar terminal array along the X-Z axes plane, but the number of coplanar terminal array is not limited hereto. Moreover, as shown in FIGS. 3A and 3B, the grounding plate 40 can also respectively split into a plurality of ground terminals 41 in the direction in which it extends through the tip exposing portion 11. The ground terminals 41 are preferably plate shape and are extends longer in length than the original tip ends 21*h*, 22*h*. Ground terminals 41 longer than the signal terminals can prevent sparks or external signal interference generated due to unstable electrical connectivity when plugging in the terminals. The ground terminals 41 are not arranged in the same planar surface with respect to the terminal pair 20. Accordingly, the first terminal 21 and the second terminal 22 are arranged inline from top to bottom as shown in FIGS. 3A and 3C, whereas the ground terminals 41 are arranged at a side (right side in the instant embodiment) of the inline first terminal 21 and the second terminal 22. In summary, the plurality of ground terminals 41 42 form a coplanar engaging terminal assembly 111 (as shown in FIG. 3A) with the terminal pairs 20 respectively in the plurality of tip exposing portions 11 and plurality of tail exposing portions 12, and form a coplanar board terminal assembly 121 (as shown in FIG. 3B).

The guiding adaptor H has a main board portion H1. The main board portion H1 has a plurality of terminal openings (not labeled) for respectively inserting the tip ends 21*h*, 22*h* of the terminal pair 20 and the ground terminals 41. As shown in FIG. 3A, the tip ends 21*h*, 22*h* and the ground terminals 41 can pass through the terminal openings of the main board portion H1 to fix the plurality of terminal lead frames TF. In conjunction with FIG. 3C, the plurality of tip ends 21*h*, 22*h* of the terminal pair 20 can cooperatively form a plurality of engaging interfaces 110 in the plurality of the coplanar tip exposing portions 11. Since the terminal frame TF is fixed, the tail ends 21*t*, 22*t* of the terminal pair 20 also individually extend from the tail exposing portion 12 to form a board end interface (not labeled) with the guiding adaptor H. Moreover, the first terminal array 111 which does not include the ground terminals 41 is then equivalent to the engaging interface 110, whereas the board terminal assembly 121 which does not include the ground terminals 42 is then equivalent to board interface (not labeled).

Please refer again to FIGS. 3A and 3C. The guiding adaptor H preferably has an upper guiding board H12 and a lower guiding board H13 respectively extending from a top and a bottom portion of the guiding adaptor H which correspond to the engaging terminal assembly 111. The guiding adaptor H also has a coupling board H11 extending therefrom. The coupling board H11 is arranged substantially in parallel with and extending opposite from the upper guiding board H12. The coupling board H11 also has a plurality of female coupling openings H110. Moreover, the grounding plates 40 further has a male coupling portion 403 upwardly extends and wound away from the engaging terminal assembly 111. The female coupling openings H110 correspond to the male coupling portions 403, such that when the guiding adaptor H is pushed towards the terminal lead frame TF along the X-axis direction, the female coupling openings H110 can correspondingly snaps into the upwardly wound male coupling portions 403. In the interior surfaces of the upper guiding board H12 and the lower guiding board H13 respectively have a plurality of fool-proof guiding rails H121, H131 which defining a plurality of guiding grooves H1210, H1310. The plurality of guiding grooves includes large guiding grooves H1210, H1310, and small guiding grooves H1211, H1311. Since the upper and lower large guiding grooves H1210, H1310 are arranged on different positions along the Z-axis, non-symmetrical upper and lower guiding rails about the Y-axis are provided as a fool-proof guidance for insertion of the guiding adaptor H into an engaging connector. For example, the guiding adaptor H' as shown in FIG. 4C has two corresponding protrusions H1210', H1310' which correspond to the two upper and lower large guiding grooves H1210, H1310 to provide fool-proof engagement between connectors.

Figure 4A:
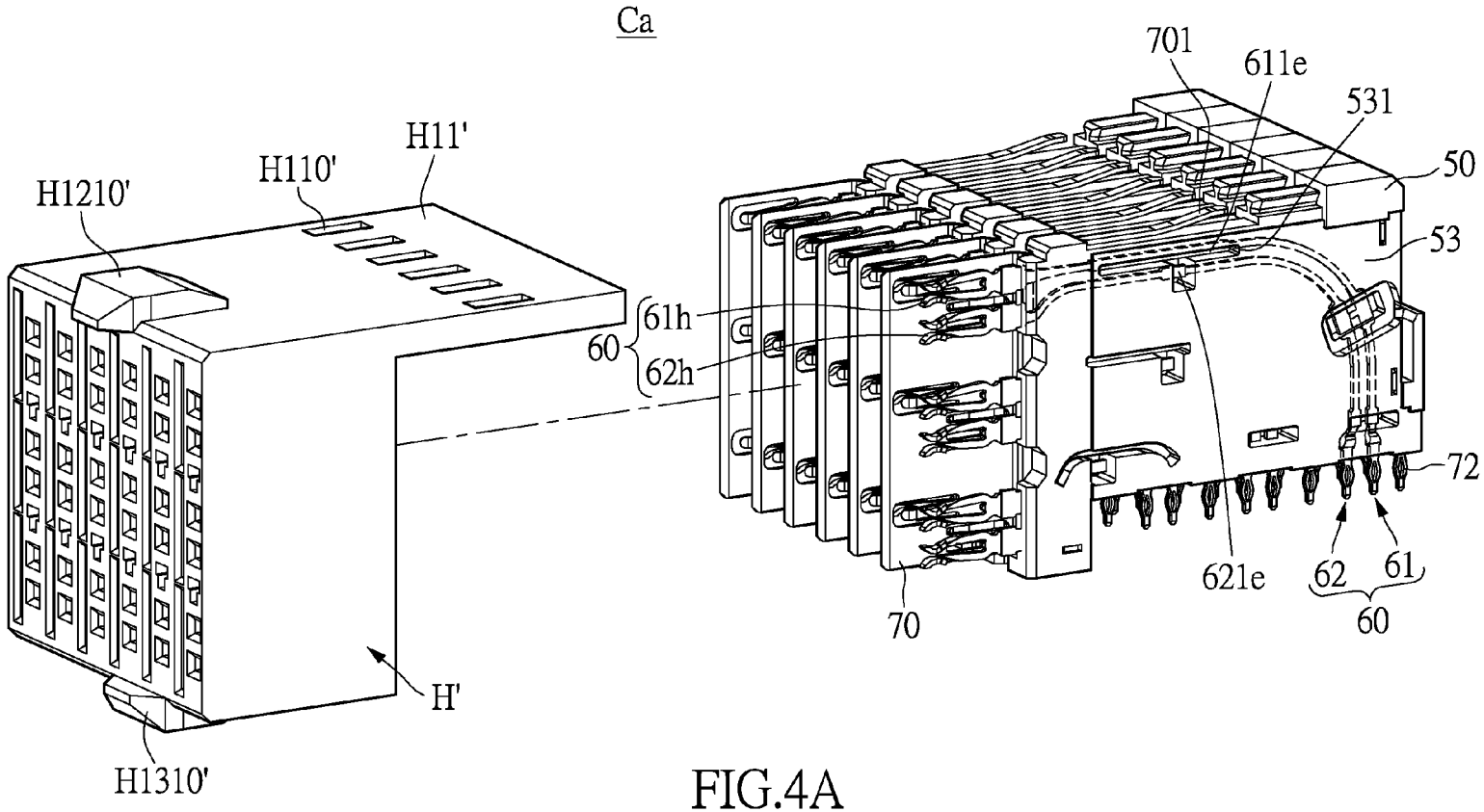
FIG. 4A is an exploded view of a communication electrical connector assembly illustrating another electrical connector and the associated engaging seat thereof in accordance with the instant disclosure.
Figure 4B:
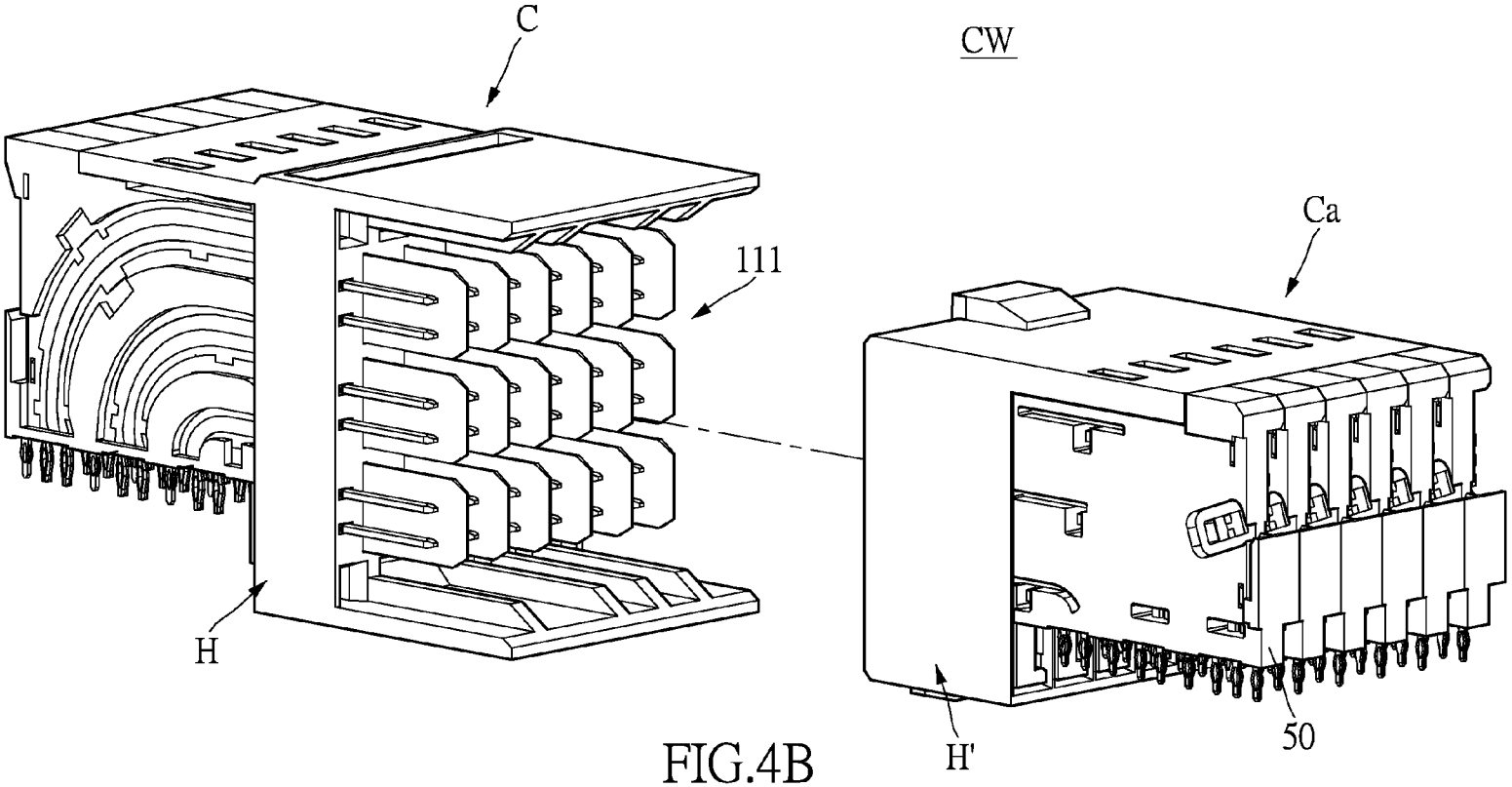
FIG. 4B is another exploded view of the communication electrical connector assembly in accordance with the instant disclosure.

Please refer to FIGS. 4A and 4B. The instant disclosure also provide an engaging connector Ca used for engaging with the communication connector C in FIG. 3A. The engaging terminal assembly 111 of the communication connector C can be engaged to a plurality of engaging terminal pairs 60 of engaging connector Ca via the engaging seat H'. The engaging terminal pairs 60 are distributed on the engaging connector Ca, and are respectively disposed in a plurality of engageable insulating frames 50. The engageable insulating frame 50 is a third dielectric in the instant embodiment, however, not limited to be identical to the first dielectric. A clamping element is preferably arranged at two tip ends 61*h*, 62*h* of a third terminal 61 and a fourth terminal 64. The engageable insulating frame 50 also has at least one side groove 531 arranged at a side 53 thereof along a third path. The side groove 531 can be filled with a fourth dielectric, such that the third terminal 61 in the engageable insulating frame 50 can be in contact with the fourth dielectric. The third terminal 61 arranged in the engageable insulating frame 50 has a third contact surface area with respect to the fourth dielectric in contact, and the fourth terminal 62 arranged in the engageable insulating frame 50 has a fourth contact surface area with respect to the fourth dielectric. Preferably, the third contact surface area is larger than the fourth contact surface area. Alternatively, at least one portion of the third terminal 61 arranged in the engageable insulating frame 50 is relative wider with respect to the third terminal 61, which forms a first widened portion 611*e*. The widened portion 611*e* can adjusts the third contact surface area. At least one portion of the fourth terminal 62 arranged in the engageable insulating frame 50 is relative wider with respect to the fourth terminal 62, which forms a second widened portion 621*e*. The widened portion 621*e* can adjusts the fourth contact surface area. Similarly, each engageable insulating frame 50 of the engaging connector Ca has a grounding plate 70 arranged thereon to prevent unnecessary crosstalk interference generated by electrical wiring (terminal pair 60) between two adjacent engageable insulating frames 50. The grounding plate 70 can also has male coupling portion 701 for engagement with the female coupling opening H110' of the engaging seat H'. Moreover, the plurality of engaging openings (no labeled) between the corresponding protrusions H1210', H1310' on the engaging seat H' is a lead frame assembly (not labeled) corresponding to the tip contact portion 61*h*, 62*h* of the terminal pairs 60. Since the plurality of the engaging terminal pairs 60 of the engageable insulating frames 50 can correspond to the plurality of coplanar engaging openings on the engaging seat H', the tip contact portions 61*h*, 62*h* are guided into the lead frame assembly, whereas the female engaging openings H110' and the lead frame assembly on the guiding adaptor H as shown in FIG. 3A respectively fix the male coupling portion 701 and the terminal pair 60, such that the side by side terminal pairs 60 and the engageable insulating frames 50 are assembled and fixed. The engaging connector Ca as shown in FIG. 4A can be coupled to the guiding adaptor H of the communication connector C via the engaging seat H', such that the engaging terminal assembly 111 can engage to the engaging connector Ca to form the communication connector assembly CW.

Figure 5A:
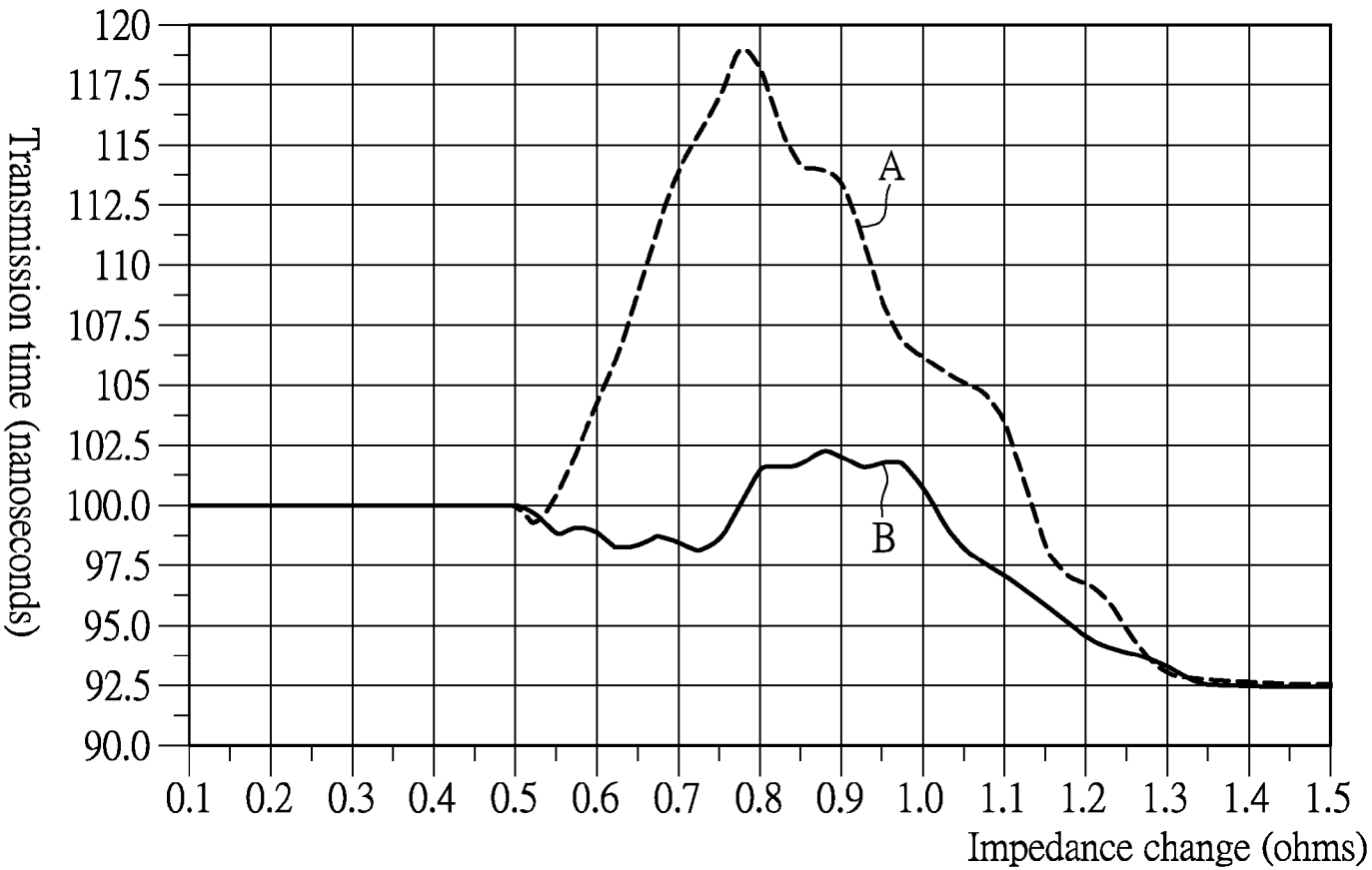
FIG. 5A is a plot of the communication connector illustrating change in impedance of a connector terminal with respect to various transmission time in accordance with the instant disclosure.
Figure 5B:
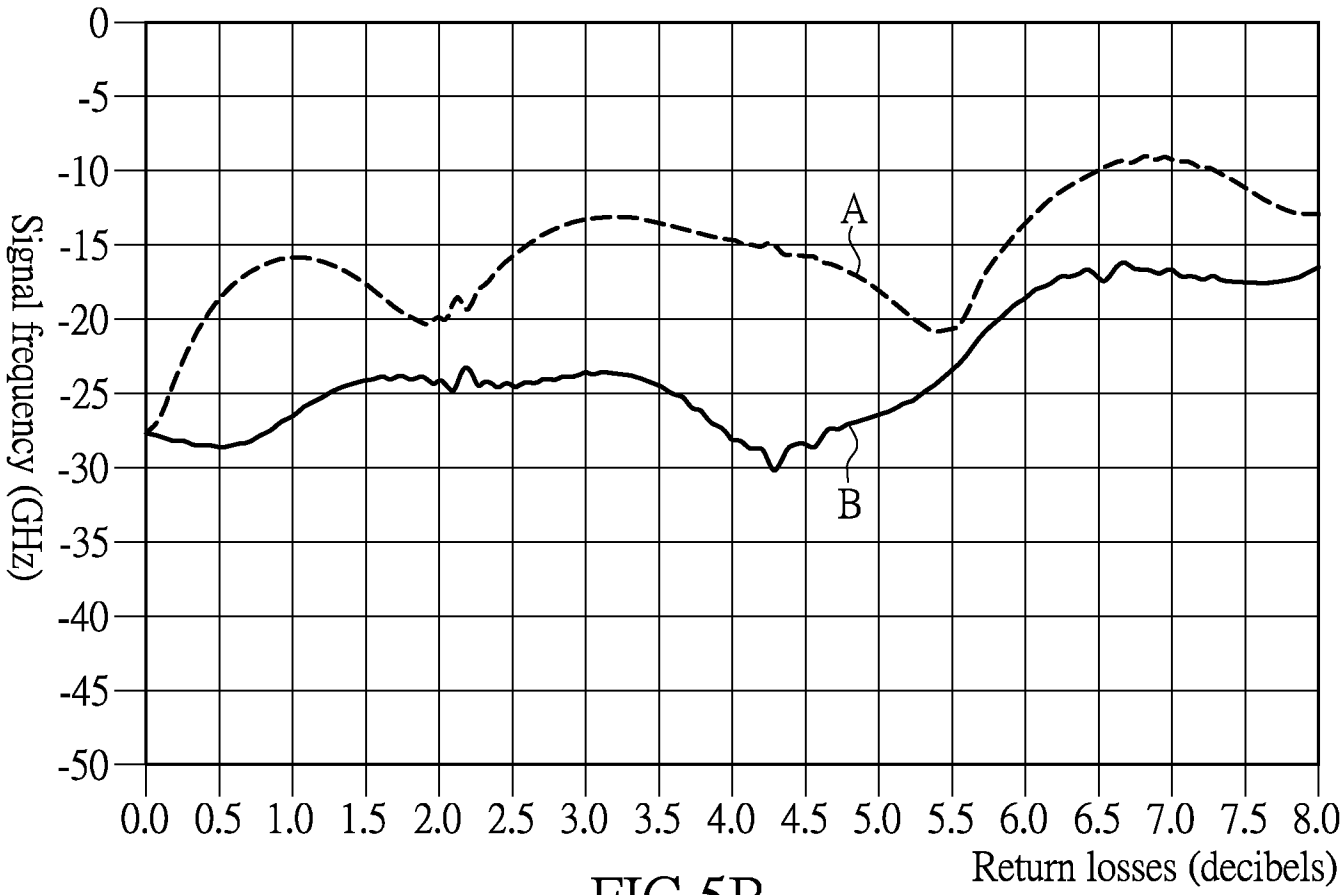
FIG. 5B is a plot of the communication connector illustrating return losses with respect to change in signal transmission frequency in accordance with the instant disclosure.

Please refer to FIGS. 5A and 5B for testing results during Differential signal transmission. In FIG. 5A, the dotted line A represents measured data according to conventional connector during electronic signal transmission, whereas solid B represents date collected according to the connectors of the instant disclosure during electronic signal transmission. During transmission as in FIG. 5A, the vertical axis shows quantitatively the connector impedance of the connector terminal at high frequency impedance (units in Ohm) with respect to transmission time (horizontal axis with units in nanoseconds). The data are preferably interpreted as the change of 100 ohm impedance for a connector terminal, where smaller change is more preferred. While dotted line A represents time zero, or before the embodying of the instant disclosure takes place, whereas solid line B represents time after zero, or when the embodying of the instant disclosure takes place. As high frequency signals are transmitting, the impedance value of the terminal begins to change illustrated by the dotted line A, while the maximum value can reach up to about 120 ohms, the minimum value can drop down to 92.5 ohms, and the amplitude change in impedance is about 7.5 to 20%. On the other hand, the amplitude change in impedance of solid line B is relatively low with respect to dotted line A, in which the variation peaks at 2.5%. Low amplitude in impedance change indicates that the load of the connector terminal during signal transmission is relatively uniform, which contributes to the stability of signal transmission. Accordingly, relatively larger impedance fluctuations are prevented, load on instruments during signal transmission is reduced, and completeness as well as quality of transmissions is maintained. Quality of signal transmission can be further examined via return loss. In FIG. 5B, the vertical axis represents the degree of signal loss, or return loss with units in decibels (dB), whereas the horizontal axis represents the signal frequency during transmission. While dotted line A represents data collected before embodiment of the instant disclosure, whereas solid line B represents data collected during embodiment of the instant disclosure. As shown in FIG. 5B, signal loss or return loss of B, embodiment of instant disclosure, is relatively less than A, not embodying the instant disclosure, which indicates enhanced transmission quality during signal transmission can be provided by the instant disclosure.

In summary, the instant disclosure provides improved signal transmission quality via the technical contents aforementioned. Furthermore, in order to facilitate engagement with various types of external terminals, corresponding terminal adjustable mechanisms are necessary to conform to the external connector terminals which can provide preferred transmission quality throughout the entire signal transmission. For example, although the terminal pairs 20 of the original communication connector C can prevent return loss during signal transmission by adjusting impedance and changing the contact dielectric or the thickness of the terminals as in FIG. 3A, when the original connector is engaged to another type of connector, such as the engaging connector Ca, as shown in FIGS. 4A and 4B, compliant terminal adjustable mechanisms corresponding to external connector terminals are necessary, such that contact with various dielectric or having various thickness of terminals is possible. Accordingly, balanced adjustments are provided to secure stable and preferred transmission quality throughout the entire signal transmission between the engagement of terminal pairs 20 and additional terminal pairs 60. The instant disclosure prefers terminals having relatively long extension path to be exposed such that the terminals can be in contact with relative more dielectric materials having a relatively low dielectric constant, thus enhanced transmission quality can be provided.

The figures and descriptions supra set forth illustrated the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A terminal lead frame, comprising:

an insulating frame being a first dielectric, the insulating frame including a tip exposing portion, a tail exposing portion, and two side surfaces; and a plurality of terminal pairs disposed in the insulating frame, at least one of the terminal pairs including a first terminal and a second terminal, the first terminal including a first extension extending along a first path, the second terminal including a second extension extending along a second path, the length of the first path is longer than the length of the second path, the first terminal and the second terminal each having a tip end extending from and arranged at the tip exposing portion, the respective tip ends of the first terminal and the second terminal extending out of the insulating frame from the first extension and the second extension, the first terminal and the second terminal each having a tail end extending from and arranged at the tail exposing portion;

wherein the first terminal and the second terminal respectively include a pair of broad sides and a pair of narrow sides along a longitudinal direction thereof, the broad side has a width larger than a width of the narrow side, the broad sides are substantially parallel to the side surface of the insulating frame, the narrow side of the first extension is electromagnetically coupled to the narrow side of the second extension;

wherein each of the tip ends has a twisted portion turned around the longitudinal direction and connected the first extension and the second extension, thereby one of the broad sides of the tip end of the first terminal faces one of the broad side of the tip end of the second terminal and facilitates engagement with an engaging terminal pair of an engaging connector;

wherein at least a portion of the first extension exposes from at least one side surface of the insulating frame and is in contact with a second dielectric to define a first contact area, at least a portion of the second extension exposes from at least one side surface of the insulating frame and is in contact with the second dielectric to define a second contact area, the first contact area is larger than the second contact area, and the dielectric constant of the second dielectric is smaller than the dielectric constant of the first dielectric.

2. The terminal lead frame as recited in claim 1, wherein the ratio of the first contact area to the second contact area is large than the ratio of the length of the first path to the length of the second path.

3. The terminal lead frame as recited in claim 2, wherein the first extension is completely exposed at a side of the insulating frame, and the second extension is completely exposed at a side of the insulating frame.

4. The terminal lead frame as recited in claim 2, wherein the first extension is exposed via a groove of the insulating frame and is in contact with the second dielectric, the second extensions is exposed via another groove of the insulating frame and is in contact with the second dielectric.

5. The terminal lead frame as recited in claim 1, wherein the terminal pair is a differential terminal pair, one of the narrow sides is defined as a coupling side and one of the broad sides is defined as a non-coupling side, the coupling side of the first extension orients toward the coupling side of the second extension, such that the coupling side of the first extension is coupled to the coupling side of the second extension, the non-coupling side of the first extension is in contact with the second dielectric, and the non-coupling side of the second extension is in contact with the second dielectric; and wherein the non-coupling side of the first extension has a width larger than a width of the non-coupling side of the second extension, so that the first extension has a contact surface area in contact with the second dielectric larger than a contact surface area of the second extension in contact with the second dielectric.

6. The terminal lead frame as recited in claim 5, wherein the first extension is completely exposed at a side of the insulating frame, and the second extension is completely exposed at a side of the insulating frame.

7. The terminal lead frame as recited in claim 5, wherein the first extension is exposed via a groove of the insulating frame and is in contact with the second dielectric, the second extension is exposed via another groove of the insulating frame and is in contact with the second dielectric.

8. The terminal lead frame as recited in claim 5, wherein the first extension has at least one part protruded therefrom along the non-coupling side of the first extension, so as to increase the contact surface area of the first extension in contact with the second dielectric.

9. The terminal lead frame as recited in claim 1, wherein the first extension is completely exposed at a side of the insulating frame, and the second extension is completely exposed at a side of the insulating frame.

10. The terminal lead frame as recited in claim 1, wherein the first extension is exposed via a groove of the insulating frame and is in contact with the second dielectric, the second extension is exposed via another groove of the insulating frame and is in contact with the second dielectric.

11. A terminal lead frame, comprising:

an insulating frame being a first dielectric, the insulating frame including a tip exposing portion, a tail exposing portion, and two side surfaces; and a plurality of terminal pairs disposed in the insulating frame, at least one of the terminal pairs including a first terminal and a second terminal, the first terminal including a first extension extending along a first path, the second terminal including a second extension extending along a second path, the length of the first path is longer than the length of the second path, the first terminal and the second terminal each having a tip end extending from and arranged at the tip exposing portion, the respective tip ends of the first terminal and the second terminal extending out of the insulating frame from the first extension and the second extension, the first terminal and the second terminal each having a tail end extending from and arranged at the tail exposing portion;

wherein the first terminal and the second terminal respectively include a pair of broad sides and a pair of narrow sides along a longitudinal direction thereof, the broad side has a width larger than a width of the narrow side, the broad sides are substantially parallel to the side surface of the insulating frame, the narrow side of the first extension is electromagnetically coupled to the narrow side of the second extension;

wherein each of the tip ends has a twisted portion turned around the longitudinal direction and connected the first extension and the second extension, thereby one of the broad sides of the tip end of the first terminal faces one of the broad side of the tip end of the second terminal and facilitates engagement with an engaging terminal pair of an engaging connector;

wherein at least a portion of the first extension exposes from at least one side surface of the insulating frame and is in contact with a second dielectric, the second extension is not exposed from the at least one side of the insulating frame and is not in physical contact with the second dielectric, and the dielectric constant of the second dielectric is smaller than the dielectric constant of the first dielectric.

12. The communication connector as recited in claim 11, wherein the terminal pair is a differential terminal pair, one of the narrow sides is defined as a coupling side and one of the broad sides is defined as a non-coupling side, the coupling side of the first extension orients toward the coupling side of the second extension, such that the coupling side of the first extension is coupled to the coupling side of the second extension, the non-coupling side of the first extension is in contact with the second dielectric; and wherein the non-coupling side of the first extension has a width larger than a width of the non-coupling side of the second extension.

13. The communication connector as recited in claim 12, wherein the first extension has at least one part protruded therefrom along the non-coupling side of the first extension, so as to increase the contact surface area of the first extension in contact with the second dielectric.

14. A communication connector, comprising:

a guiding adaptor; and a plurality of terminal lead frames, at least one of the terminal lead frame comprising:

an insulating frame being a first dielectric, the insulating frame including a tip exposing portion, a tail exposing portion, and two side surfaces, a direction normal to the side surfaces defined as a first direction, the insulating frames of the terminal lead frames are arranged side by side one another along the first direction in guiding adaptor; and a plurality of terminal pairs disposed in the insulating frame, at least one of the terminal pairs including a first terminal and a second terminal, the first terminal including a first extension extending along a first path, the second terminal including a second extension extending along a second path, the length of the first path is longer than the length of the second path, the first terminal and the second terminal each having a tip end extending from and arranged at the tip exposing portion, the respective tip ends of the first terminal and the second terminal extending out of the insulating frame from the first extension and second extension, the first terminal and the second terminal each having a tail end extending from and arranged at the tail exposing portion;

wherein the first terminal and the second terminal respectively include a pair of broad sides and a pair of narrow sides along a longitudinal direction thereof, the broad side has a width larger than a width of the narrow side, the broad sides are substantially parallel to the side surface of the insulating frame, the narrow side of the first extension is electromagnetically coupled to the narrow side of the second extension;

wherein each of the tip ends has a twisted portion turned around the longitudinal direction and connected the first extension and the second extension, thereby one of the broad sides of the tip end of the first terminal faces one of the broad side of the tip end of the second terminal and facilitates engagement with an engaging terminal pair of an engaging connector;

wherein at least a portion of the first extension exposes from at least one side surface of the insulating frame and is in contact with a second dielectric to define a first contact area, at least a portion of the second extension exposes from at least one side surface of the insulating frame and is in contact with the second dielectric to define a second contact area, the first contact area is larger than the second contact area, and the dielectric constant of the second dielectric is smaller than the dielectric constant of the first dielectric;

wherein the plurality of terminal pairs disposed in the tip exposing portions are configured to form an engaging interface and are fitted to the guiding adaptor;

wherein the plurality of terminal pairs disposed in the tail exposing portions are configured to form a board interface.

15. The communication connector as recited in claim 14, wherein the ratio of the first contact area to the second contact area is larger than the ratio of the length of the first path to the length of the second path.

16. The communication connector as recited in claim 15 further comprising:

a plurality of grounding plates arranged between the insulating frames, each of the grounding plates having a plurality of ground terminals extending therefrom and extending from the tip exposing portions and the tail exposing portions respectively, each of the ground terminals arranged between the terminal pairs, and the ground terminals form an engaging terminal assembly with the engaging interface and an board terminal assembly with the board interface respectively.

17. The communication connector as recited in claim 14, wherein the terminal pair is a differential terminal pair, one of the narrow sides is defined as a coupling side and one of the broad sides is defined as a non-coupling side, the coupling side of the first extension orients toward the coupling side of the second extension, such that the coupling side of the first extension is coupled to the coupling side of the second extension, the non-coupling side of the first extension is in contact with the second dielectric, and the non-coupling side of the second extension is in contact with the second dielectric; and wherein the non-coupling side of the first extension has a width larger than a width of the non-coupling side of the second extension, so that the first extension has a contact surface area in contact with the second dielectric larger than a contact surface area of the second extension in contact with the second dielectric.

18. The communication connector as recited in claim 17 further comprising:

a plurality of grounding plates arranged between the insulating frames, each of the grounding plates having a plurality of ground terminals extending therefrom and extending from the tip exposing portions and the tail exposing portions respectively, and each of the ground terminals arranged between the terminal pairs, the ground terminals form an engaging terminal assembly with the engaging interface and an board terminal assembly with the board interface respectively.

19. The terminal lead frame as recited in claim 17, wherein the first extension has at least one part protruded therefrom along the non-coupling side of the first extension, so as to increase the contact surface area of the first extension in contact with the second dielectric.

20. The communication connector as recited in claim 14 further comprising:

a plurality of grounding plates arranged between the insulating frames, each of the grounding plates having a plurality of ground terminals extending therefrom and extending from the tip exposing portions and the tail exposing portions respectively, and each of the ground terminals arranged between the terminal pairs, the ground terminals form an engaging terminal assembly with the engaging interface and a board terminal assembly with the board interface respectively.

* * * * *